US009163346B2

(12) United States Patent
Bonlender et al.

(10) Patent No.: US 9,163,346 B2
(45) Date of Patent: Oct. 20, 2015

(54) WASHING MACHINE CONTROL SYSTEM AND METHODS

(71) Applicant: Alliance Laundry Systems LLC, Ripon, WI (US)

(72) Inventors: Michael Bonlender, Eldorado, WI (US); Andrew Huerth, Green Lake, WI (US); Andrew Kegler, Ripon, WI (US)

(73) Assignee: Alliance Laundry Systems, LLC, Ripon, WI (US)

( * ) Notice: Subject to any disclaimer, the term of this patent is extended or adjusted under 35 U.S.C. 154(b) by 53 days.

(21) Appl. No.: 14/167,640

(22) Filed: Jan. 29, 2014

(65) Prior Publication Data

US 2015/0211168 A1 Jul. 30, 2015

(51) Int. Cl.

| | |
|---|---|
| ***D06F 37/30*** | (2006.01) |
| ***D06F 33/02*** | (2006.01) |
| ***D06F 37/20*** | (2006.01) |
| ***D06F 37/22*** | (2006.01) |

(52) U.S. Cl.

CPC ..... *D06F 37/304* (2013.01); *D06F 33/02* (2013.01); *D06F 37/203* (2013.01); *D06F 37/22* (2013.01); *D06F 2202/06* (2013.01); *D06F 2204/065* (2013.01); *D06F 2700/04* (2013.01)

(58) Field of Classification Search

None

See application file for complete search history.

(56) References Cited

U.S. PATENT DOCUMENTS

| | | | | |
|---|---|---|---|---|
| 2,984,094 | A | 5/1961 | Belaieff | |
| 3,494,471 | A | 2/1970 | Grippo | |
| 4,433,592 | A | 2/1984 | Tatsumi et al. | |
| 5,460,017 | A | 10/1995 | Taylor | |
| 5,746,069 | A | 5/1998 | Kim | |
| 5,850,749 | A | 12/1998 | Kim | |
| 6,658,902 | B2 | 12/2003 | Southworth et al. | |
| 7,861,560 | B2 | 1/2011 | Ryu et al. | |
| 8,074,476 | B2 | 12/2011 | Quandt | |
| 8,186,183 | B2 | 5/2012 | Esser | |
| 2002/0016997 | A1 | 2/2002 | Jonsson | |
| 2005/0283919 | A1 * | 12/2005 | Kim | 8/158 |
| 2009/0183318 | A1 * | 7/2009 | Kim et al. | 8/159 |
| 2010/0088829 | A1 * | 4/2010 | Park | D06F 37/245 8/159 |

FOREIGN PATENT DOCUMENTS

KR 2005-0110071 A 11/2005

* cited by examiner

*Primary Examiner* — Michael Barr
*Assistant Examiner* — Cristi Tate-Sims
(74) *Attorney, Agent, or Firm* — Leydig, Voit & Mayer, Ltd.

(57) ABSTRACT

A washing machine system comprising an outer tub with a basket rotatably supported within the outer tub. The basket receives launderable items and wash water. The washing machine includes a drive motor that rotates the basket during the wash operation, and a balance ring associated with the basket containing counterweights that move within the balance ring to compensate for an imbalanced mass in the basket. The washing machine includes a controller communicating with the motor. The controller sends signals to the motor to rotate the basket at selective rotational speeds, and receives electronic signals indicating the power used to rotate the basket at selective speeds. The controller compensates for the imbalanced mass by preventing the drive motor from rotating the basket at a substantially constant speed between a predetermined minimum resonance speed and a predetermined maximum resonance speed for more than a predetermined maximum dwell time during the wash operation.

16 Claims, 11 Drawing Sheets

WASHING MACHINE CONTROL SYSTEM AND METHODS

TECHNICAL FIELD

This patent disclosure relates generally to washing machines and, more particularly, to balancing systems for washing machines.

BACKGROUND

Drum-type washing machines generally have a body that makes up the outer frame of the washing machine, a tub within the body for receiving and holding wash material, and a rotating drum within the tub driven by a motor. During the wash process, laundry within the rotating drum is repeatedly raised and dropped as it mixes with wash water within the tub. The drum rotates at varying speeds during different stages of the wash process, such as lower speeds during the wash cycle, and higher speeds during the drying or dehydrating cycle.

As the drum, which is loaded with wash material, rotates and water is added and removed from the wash material during a wash operation, the total weight of the loaded drum may become imbalanced. An imbalanced load within the rotating drum can cause the machine to vibrate or shake as the mass within the drum rotates, which can result in loud operation or even machine damage. To account for this imbalance, some drum-type washing machines use counter-weights to offset the imbalanced wash load. One type of counter-weight system includes spheres that can run in a track around the periphery of the rotating drum. As the drum rotates, the counter-weighting balls move to the opposite side of the drum than the imbalanced wash load to help counteract the load imbalance within the drum.

Even when counter-weights are used to counteract imbalanced wash loads, problems with vibration and excess noise can occur at certain drum rotation frequencies during the washing operation. For example, at some spin speeds, spherical balls used as counterweights can remain in a state of transition as they lag behind the drum spin speed. As this lag occurs, the transitioning counterweights sometimes correct the imbalanced load, but can also add to the imbalanced load while in transition. This effect is particularly prevalent close to resonance frequencies of the combined rotating mass of the drum and the wash material. These and other issues can be addressed as described herein.

SUMMARY

The disclosure describes, in one aspect, a washing machine system comprising an outer tub with a cylindrical basket rotatably supported within the outer tub. The basket can receive launderable items and wash water during a wash operation. The washing machine system also includes a drive motor adapted to selectively rotate the basket during the wash operation, and a balance ring associated with the basket. The balance ring contains at least one counterweight adapted to move within the balance ring to compensate for an imbalanced mass during rotation of the basket. The washing machine system also includes a controller in electronic communication with the drive motor. The controller is adapted to send signals to the drive motor instructing the drive motor to rotate the basket at selective rotational speeds, and to receive electronic signals indicating an amount of power used by the drive motor to rotate the basket at the selective rotational speeds. The controller is further adapted to compensate for the imbalanced mass during rotation of the basket by preventing the drive motor from rotating the basket at a substantially constant speed between a predetermined minimum resonance speed and a predetermined maximum resonance speed for more than a predetermined maximum dwell time during the wash operation.

In another aspect, the disclosure describes a method of operating a washing machine system. The method comprises providing an outer tub and rotatably supporting a cylindrical basket within the outer tub. The basket is adapted to receive launderable items and wash water during a wash operation. The method also includes providing a drive motor adapted to selectively rotate the basket during the wash operation, and mounting a balance ring to the periphery of the basket. The balance ring contains at least one counterweight ball adapted to move within the balance ring to compensate for an imbalanced mass during rotation of the basket. The method also includes electronically connecting a controller to the drive motor, sending signals to the drive motor from the controller instructing the drive motor to rotate the basket at selective rotational speeds, and receiving signals with the controller indicating an amount of power used by the drive motor to rotate the basket at the selective rotational speeds. The method includes using the controller to instruct the motor to rotate the basket at zero acceleration for no more than a predetermined maximum dwell time when the rotational speed of the basket is between a minimum resonance speed and a maximum resonance speed.

In yet another aspect, the disclosure describes a method of operating a washing machine system. The method comprises providing an outer tub, and rotatably supporting a cylindrical basket within the outer tub. The basket is adapted to receive launderable items and wash water during a wash operation. The method also includes providing a drive motor adapted to selectively rotate the basket during the wash operation. The method includes mounting a balance ring to the periphery of the basket. The balance ring contains at least one counterweight ball adapted to move within the balance ring to compensate for an imbalanced mass during rotation of the basket. The method includes electronically connecting a controller to the drive motor, sending signals to the drive motor from the controller instructing the drive motor to rotate the basket at selective rotational speeds, and receiving signals with the controller indicating an amount of power used by the drive motor to rotate the basket at the selective rotational speeds. The method includes using the controller to determine at least one resonance speed of the washing machine system based on the amount of power used by the drive motor at the selective rotational speeds, where the resonance speed is the rotational speed of the basket at which the washing machine system experiences a resonance frequency. The method also includes using the controller to determine an imbalanced-load parameter based on the amount of power used by the drive motor to rotate the basket at the selective rotational speeds.

DETAILED DESCRIPTION

Figure 1:
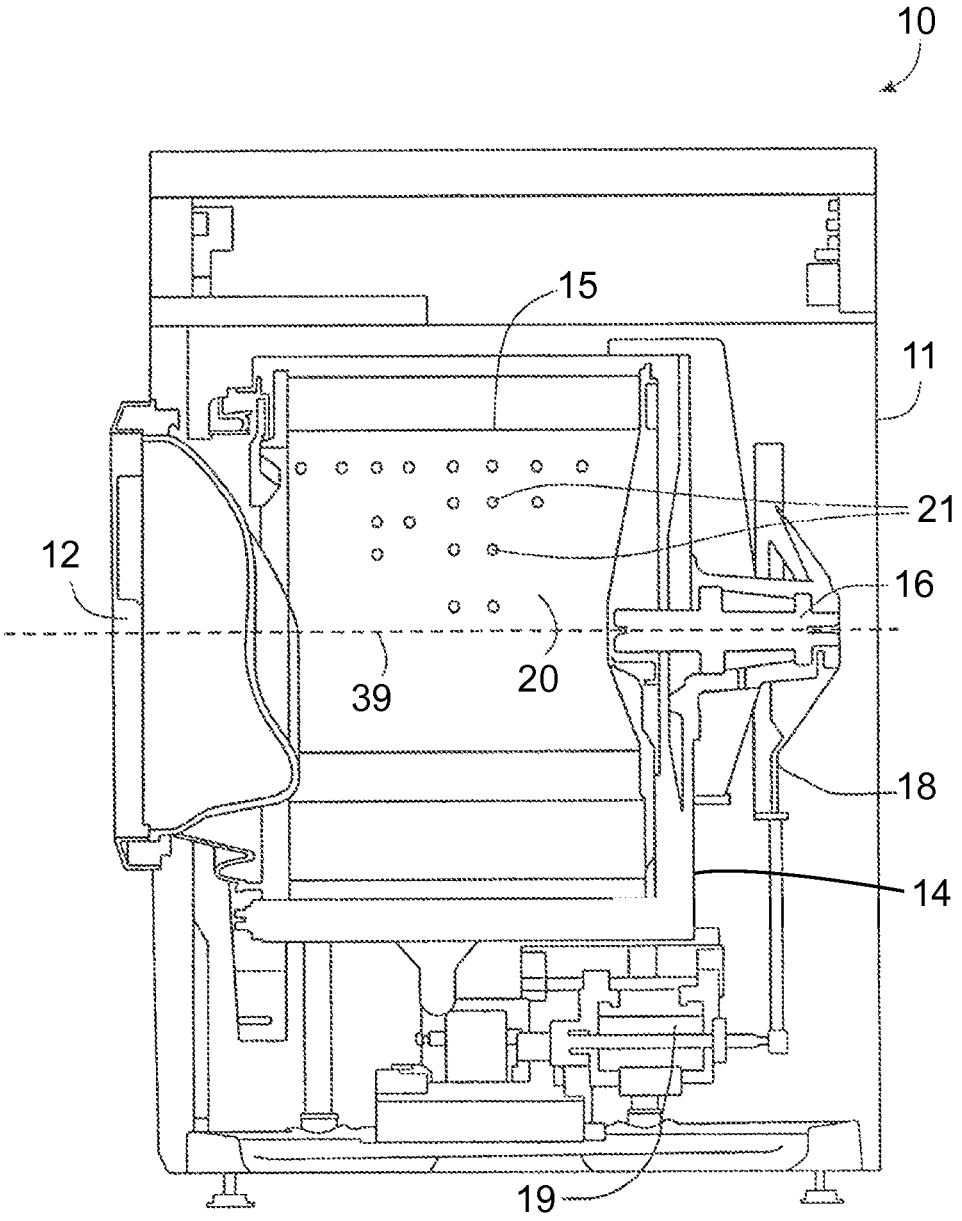
FIG. 1 is a partial diagrammatic, section view of a washing machine system having in accordance with the disclosure.

This disclosure relates to a washing machine control system for preventing or at least mitigating machine noise, vibration and/or other effects on machine operation during drum rotation at or close to drum resonant frequencies. Referring to the drawings, FIG. 1 shows an embodiment of a horizontal axis washing machine 10. The washing machine 10 includes a cabinet or frame 11 with a front opening access door 12, a front opening outer tub 14 mounted within the frame 11 for receiving water and wash chemicals, and a front opening inner tub or basket 15 for receiving launderable items rotatably supported within the outer tub 14.

Figure 2:
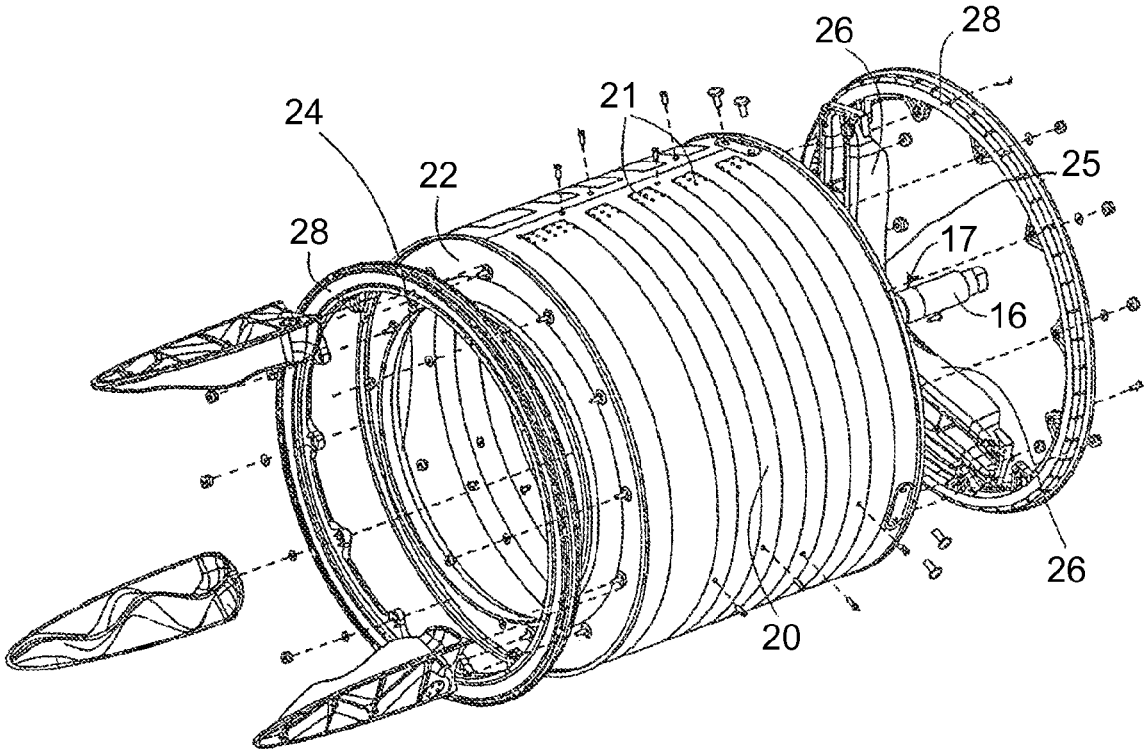
FIG. 2 is an enlarged exploded perspective view of a rotary basket of the washing machine system of FIG. 1.

As shown in FIG. 2, the inner basket 15 has a trunnion assembly 17 including a drive shaft 16 that extends rearwardly from the inner basket, i.e., away from the front opening access door 12. The drive shaft 16 is driven by a drive motor 19 (FIG. 1) disposed below the outer tub via a pulley 18. It should be understood that other suitable washing machine constructions known in the art can be used, which may differ from the exemplary embodiments illustrated herein. However, the desirable effects of the systems and methods described herein have universal applicability to any such machine constructions and, in general, to any machines or structures having masses associated therewith that rotate at variably selectable speeds. In the illustrated embodiment, the drive motor 19 operates to successively rotate the clothes-containing basket 15 in opposite rotary directions during a washing operation to facilitate agitation and cleaning of the contained launderable items. In the illustrated embodiment, the drive motor 19 rotates the basket 15 about a rotary axis 39 of the basket.

Referring again to FIG. 2, the inner basket 15 comprises a cylindrical sidewall 20 formed with perforations 21, which permit transfer of wash water into and out from the wash tub 14 and the inner basket. An annular front collar 22 extends radially inwardly from the cylindrical side wall 20 defining a front opening 24 of the inner wash basket. A circular back panel 25 is fixed to a rear end of the rotary basket 15. The back panel 25 of the wash basket 15 is fixed to three radial legs 26 of the trunnion assembly 17 in a conventional manner. In the illustrated embodiment, balance rings 28 are fixed adjacent to the front and back ends of the rotary basket 15 for facilitating balancing of rotary movement of the basket. Although two balance rings 28 are shown in FIG. 2, it is contemplated that alternative embodiments can include any number of balance rings or other rotatable, counter-weight masses associated with the wash basket 15 and/or associated structures.

Figure 3:
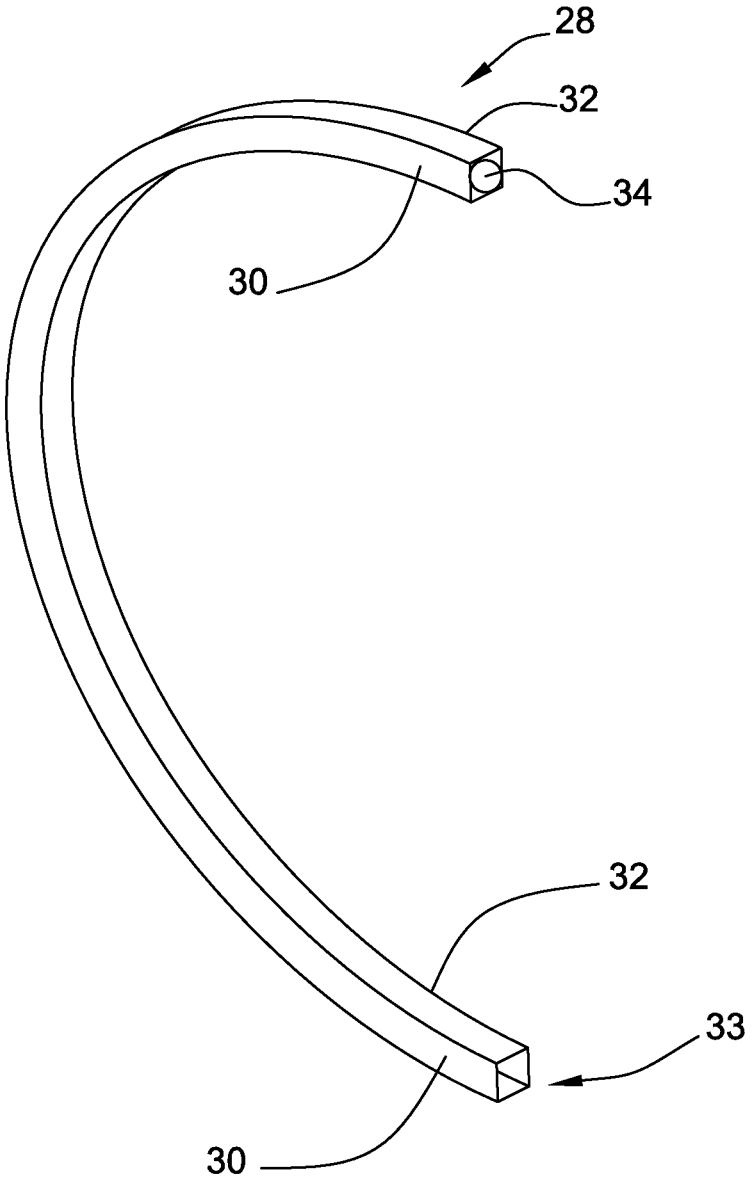
FIG. 3 is a partial perspective view of a balance ring of the washing machine system of FIG. 1.

FIG. 3 illustrates a balance ring 28 shown cut substantially in half for illustrative purposes. The balance ring 28 has a first sidewall 30 and a second sidewall 32, which are coupled to one another to form a race 33 therebetween. A plurality of spherical counterweight balls 34 are disposed within the race 33 of the balance ring 28 and adapted to move along the race 33 to compensate for imbalanced mass in the basket 15. Generally, the counterweight balls 34 will align themselves within the balance ring 28 at a position with respect to the rotating basket 15 that is opposite the position of the imbalanced mass within the basket to compensate for the imbalanced mass during rotation. This alignment can help reduce excess movement, vibration and noise resulting from the imbalanced wash load.

Even when a washing machine is equipped with balancing rings, excessive noise and machine movement can occur when the basket 15 has an imbalanced load and rotates at or near resonance frequencies. Such effects can be especially prevalent when the basket speed dwells at or near the resonance frequency or its harmonics. In this way, at low to mid-range rotational speeds the spherical balls 34 can stay in a state of transition as they lag behind the basket 15 rotational speed. It is posited that, in such instances, the basket 15 rotational speed, or basket speed, is greater than the counterweight balls 34 rotational speed, or counterweight speed. When the counterweight balls 34 are positioned opposite the imbalanced mass in the basket 15, the balls tend to counteract the effects of the imbalanced mass and reduce negative effects, such as vibration. As the counterweight balls 34 transition, however, closer to the imbalanced mass within the basket, the balls will tend to amplify any negative effects of the imbalanced mass, which may result in rough and noisy machine operation.

Figure 4:
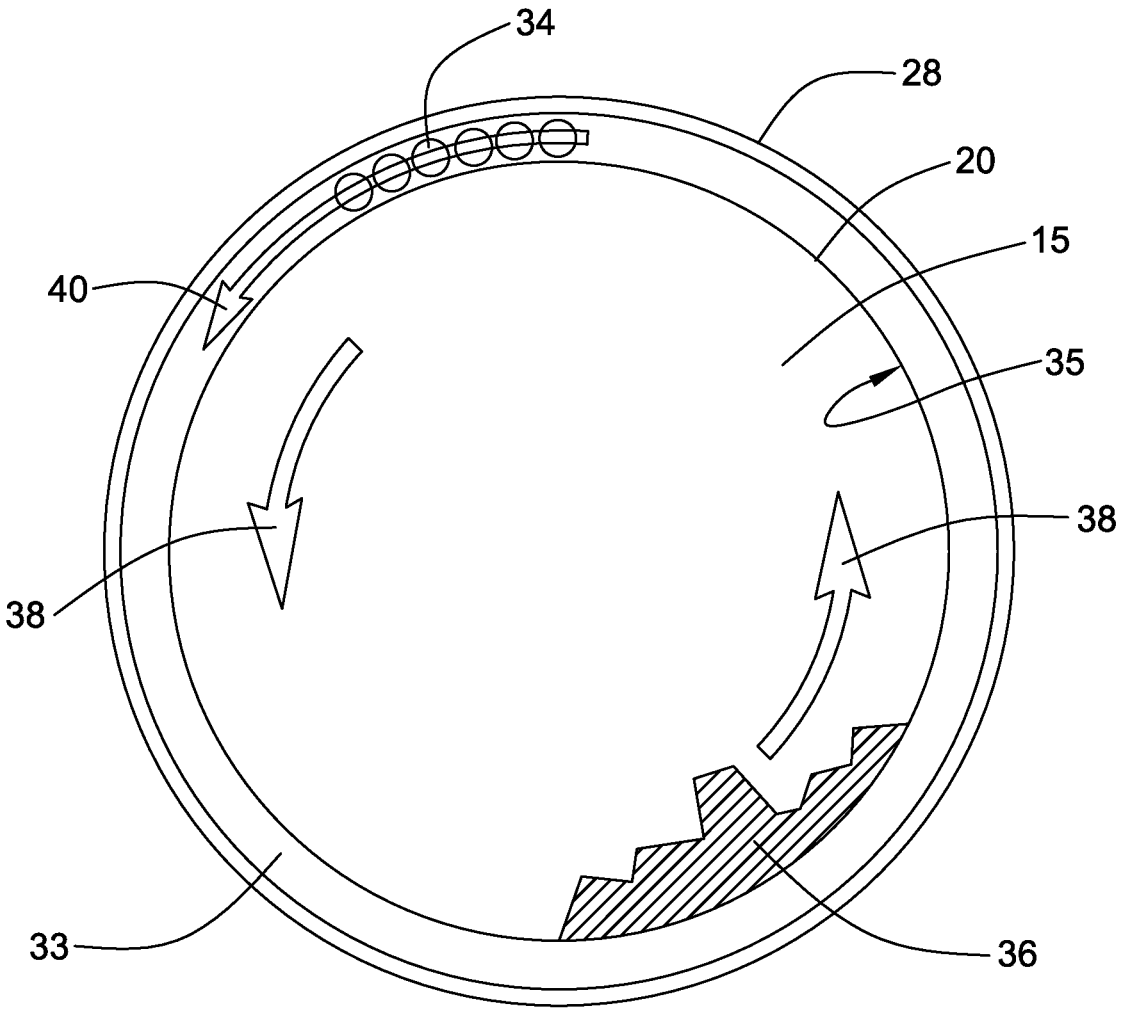
FIG. 4 is a partial diagrammatic, section view of the rotary basket of FIG. 2 with counterweight balls in a out-of-phase position.

FIG. 4 illustrates how the counterweight balls 34 can, in some circumstances, mitigate the negative effects of an imbalanced load. FIG. 4 shows the rotary basket 15 equipped with a balance ring 28 that includes a plurality of spherical counterweight balls 34. The basket 15 is shown with an imbalanced mass 36 at one radial location in the basket, and the counterweight balls 34 are disposed opposite the imbalanced mass. As the basket 15 rotates, centrifugal forces acting on the imbalanced mass 36 may press the same against the inner wall 35 of the cylindrical sidewall 20 of the basket. In FIG. 4, load arrow 38 represents the rotational speed of the imbalanced mass 36, and a counterweight arrow 40 represents the rotational speed of the counterweight balls 34, i.e., the counterweight speed. When the basket 15 rotates at rotational speeds that generate an outward, centrifugal force on the imbalanced mass 36 that meet or exceed the force due to the acceleration of gravity (1 G), the imbalanced mass will be urged to remain in the same relative location against the inner wall 35 of the basket 15. At such speeds, the rotational speed of the imbalanced mass 36 is substantially equal to the basket 15 rotational speed, i.e., the basket speed.

Figure 5:
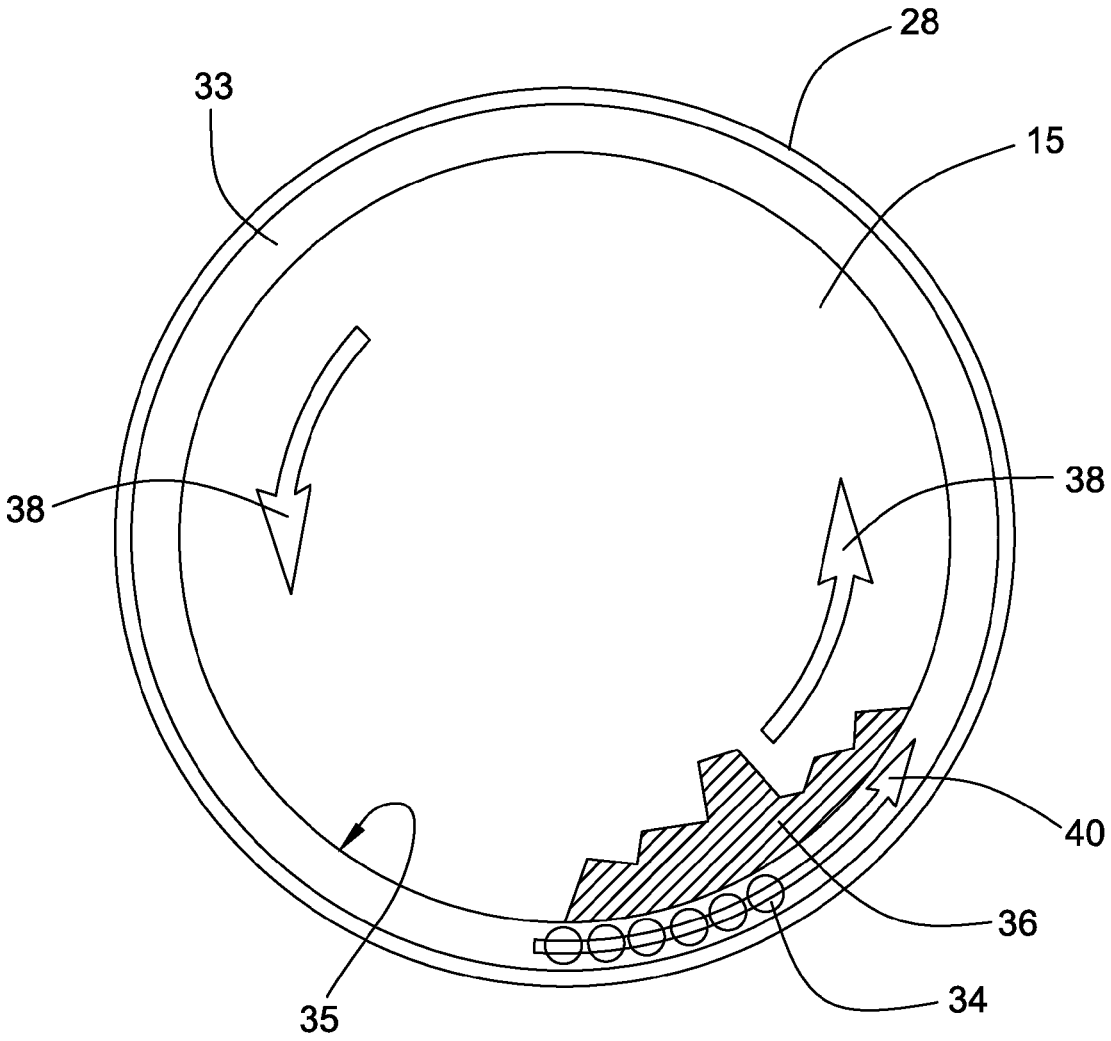
FIG. 5 is a partial diagrammatic, section view of the rotary basket of FIG. 2 with counterweight balls in an in-phase position.

In contrast, the counterweight speed of the counterweight balls 34 may lag at least slightly behind the basket speed and the imbalanced mass 36. As illustrated in FIG. 5, when the basket 15 rotates at a steady rate, the relative speed difference between the basket 15 speed of the imbalanced mass 36 the counterweight speed of the counterweight balls 34 may result in the counterweight balls gradually transitioning from a relative position within the balance ring 28 that is opposite the imbalanced mass to a relative position that approaches and, eventually, may match the position of the imbalanced mass with respect to the basket. In such a position, the mass of the counterweight balls 34 will add to the mass of the imbalanced mass 36 relative to the rotating basket such that any mass imbalance effects on the basket are amplified causing machine vibration and noise.

As the basket 15 continues to rotate, however, the counterweight balls 34 continue to rotate along the race 33 within the balance ring 28 such that, at certain time intervals, the counterweight balls alternately offset the effects of the imbalanced mass 36 and add to the effects of the imbalanced mass. The time interval between an out-of-phase condition, in which the counterweight balls 34 counteract the imbalanced mass 36 (FIG. 4), and an in-phase condition, in which the counterweight balls add to the imbalanced mass (FIG. 5) can be predicted, for example, based on empirical data, or measured directly. A predetermined maximum dwell time can be defined as the time interval between the out-of-phase and the in-phase conditions at a constant rotational basket speed. In some embodiments, the predetermined maximum dwell time can be about eight seconds to about ten second, but can be other time lengths in other embodiments. This time increment between in-phase and out-of-phase counterweight ball 34 position can be predicted based on a given basket 15 rotational speed and a particular balance ring 28 configuration. For example, the balance ring 28 can be disposed on the basket 15 in various positions, such as near the front, in the middle, or near the back of the basket.

Figure 6:
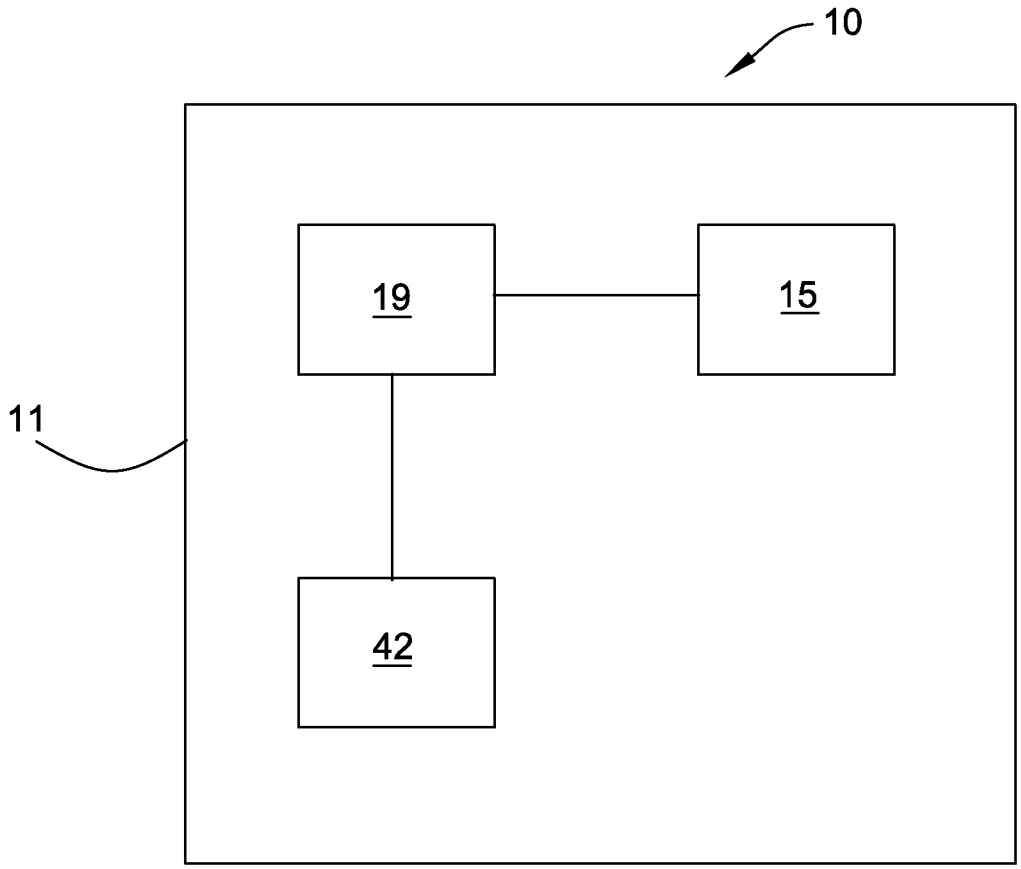
FIG. 6 is a partial block diagram of the washing machine system of FIG. 1.

Referring now to FIG. 6, a block diagram of an embodiment of the washing machine 10 is shown. The block diagram illustrates the washing machine 10 including the rotational basket 15 in mechanical connection to the drive motor 19 such that the drive motor is adapted to rotate the basket at various rotational speeds. A controller 42 is in electronic communication with the drive motor 19 such that the controller is adapted to selectively transmit electronic signals to the drive motor instructing the drive motor to rotate the basket 15 at selective rotational speeds. The controller 42 is additionally adapted to receive signals from the drive motor 19 indicative of the amount of power the drawn by the motor to rotate the basket 15 at a given moment in time. Based on the amount of power drawn by the drive motor 19 to rotate the basket 15 and the particular rotational speed of the basket, the controller 42 is adapted to determine parameters that reflect the characteristics of the load contained within the basket. For example, fluctuations in the power drawn by the drive motor 19 while the basket 15 rotates at a substantially constant rotational speed can correspond to a range of predetermined, imbalanced-load parameters. In some embodiments, the value of the imbalanced-load parameter represents a combination of the load weight and the degree to which the load is out of balance at a given time. In the described embodiments, the imbalanced-load parameter is a non-dimensional parameter indicative of the extent of load imbalance within the basket. In alternative embodiments, however, other methods and/or structures for calculating out-of-balance weight, degree of imbalance, or positioning of the out-of-balance portion of the load can be used. For example, the imbalanced-load parameter may be a quantitative parameter indicative of a mapping of the weight of the basket load with respect to a position within the basket.

During a wash operation, the washing machine 10 can go through various sequential cycles, such as a soak cycle, a wash cycle, a spin cycle, a dry or dehydrating cycle, etc. For each cycle, the controller 42 signals the drive motor 19 to rotate the basket 15 at predetermined speeds for predetermined time intervals. The time intervals at a particular rotational basket 15 speed can be only momentary, such as when the basket speed is being ramped up or down. A particular cycle can include various different rotational speeds. Functions of certain cycles, such as draining wash water from the basket 15 during a dry cycle, are ideally performed at or near certain empirically-determined rotational speeds, i.e., "dwell" speeds. For certain wash functions with certain load weights or certain imbalanced-load parameters, however, the desired dwell speed for that wash function may correspond with a resonance frequency of the washing machine. As is well known, the resonance frequency of a system is based on physical characteristics of that system. Resonance frequencies are frequencies at which a vibrating or oscillating system will tend to oscillate with greater amplitude for a given input than would otherwise be experienced at other frequencies. When the basket 15 in the washing machine 10 rotates at a speed that causes an imbalanced load to oscillate at or near the resonance frequency of the machine, the likelihood of noise, vibration and other effects to the washing machine due to vibration increases. Thus, in operating conditions where the counterweight balls 34 may align with the imbalanced mass 36 relative to the basket 15 can be particularly problematic at or near resonance speeds.

To avoid possible undesirable operating attributes of the machine 10 during basket rotation at or near resonance frequencies, the controller 42 is adapted to avoid extended dwell times at or substantially near resonance speeds, which are the rotational speeds at which the washing machine 10 and a particular wash load may encounter resonance frequencies. The controller 42 is adapted to prevent the drive motor 19 from rotating the basket at selective rotational speeds or ranges of rotational speeds that correspond to resonance frequencies for longer than a predetermined, sustained time period. When the wash cycle of a machine requires operation at conditions at or about a resonant frequency, be it steady, close to a resonant frequency, or a transient speed change passing through a resonant frequency or one of its harmonics, the controller 42 may advantageously modulate the rotational speed of the bucket within a relatively narrow range below and above the resonant speed, or its harmonics, to avoid any undesirable vibration effects of the machine. In one embodiment, the controller 42 instructs the motor 19 to maintain a non-zero basket 15 rotational acceleration when the rotational speed of the basket is at or near the resonance speed. In other embodiments, the controller 42 instructs the motor 19 to maintain a zero basket 15 rotational acceleration for no longer than a predetermined length of time when the rotational speed of the basket is in a range between a minimum resonance speed and a maximum resonance speed.

Figures 7A, 7B:
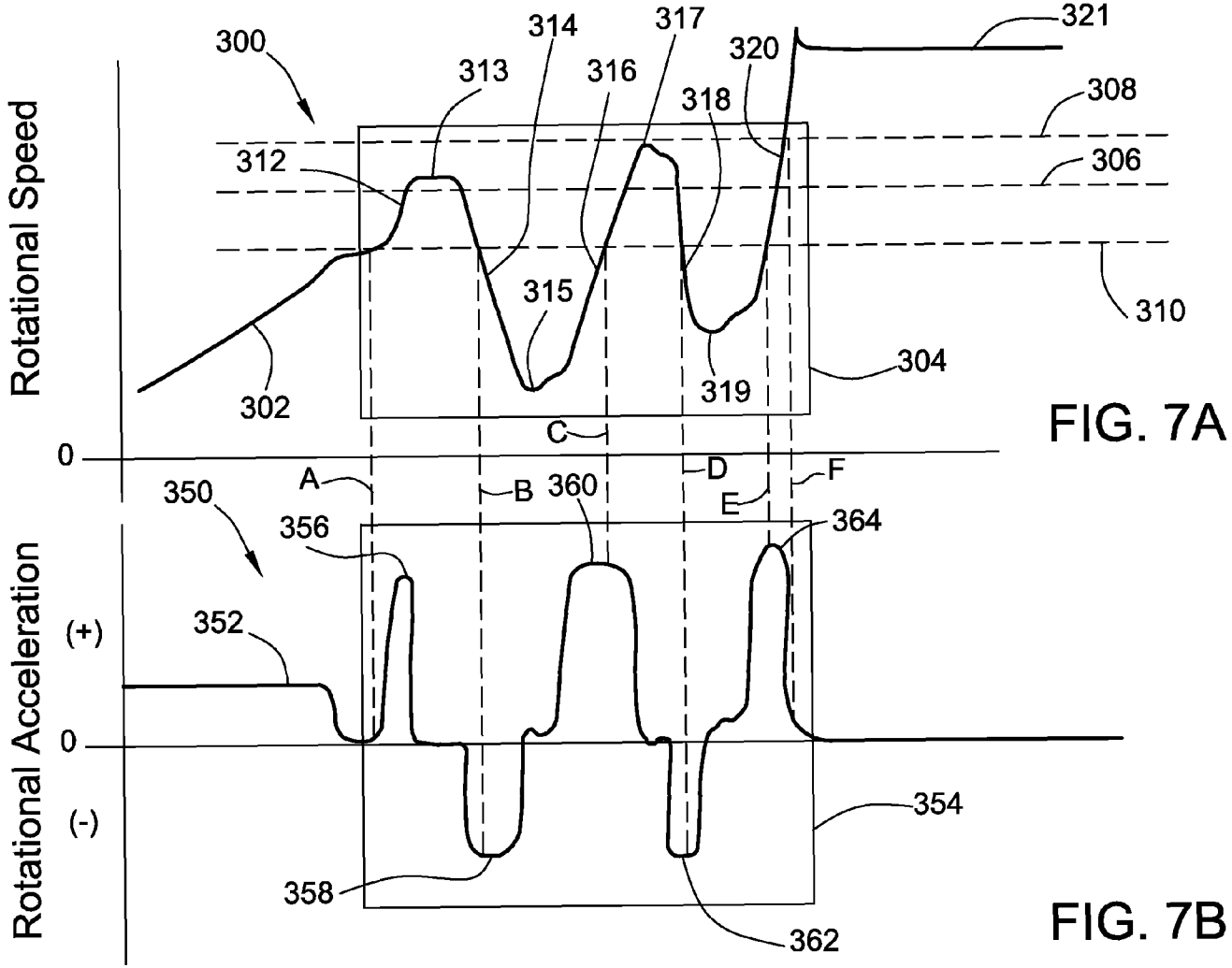
FIG. 7A is a partial graphical representation of the rotational speed over time of the rotary basket of FIG. 2 in an embodiment of the washing machine control procedure in accordance with the disclosure.
FIG. 7B is a partial graphical representation of the rotational acceleration over time of the rotary basket of FIG. 2 in the embodiment the washing machine control procedure of FIG. 7A.

FIG. 7A is a speed graph 300 illustrating one embodiment of a speed trace that includes a speed modulation to avoid excessive vibration due to resonance in accordance with the disclosure. The vertical axis of the graph represents the rotational speed of the basket 15, and the horizontal axis of the graph represents time. A speed plot 302 represents the rotational speed of the basket 15 at a given time. It should be understood that any suitable speeds and time values can be used, and the graph in FIG. 7A does not indicate any specific embodiment. FIG. 7B shows an acceleration graph 350 with plot 352, which corresponds to the time-rate-of-change of the speed graph 300 in FIG. 7A. Thus, the acceleration plot 352 represents the rotational acceleration of the basket 15 at a given time. As shown in the acceleration plot 352, the basket 15 rotational acceleration is above zero when the speed plot 302 has a positive slope, i.e., is increasing in speed. In contrast, the acceleration plot 352 is below zero when the speed plot 302 has a negative slope, i.e., the basket 15 rotation is slowing down. The acceleration plot 352 is zero when the speed plot 302 is level, i.e., the rotational speed of the basket 15 is constant. Although the acceleration of the basket is shown to be constant over certain periods of operation, a non-constant acceleration may also be used.

An indicated section 304 of the speed plot 302 is a graphical representation of an embodiment of an exemplary wash operation procedure as disclosed herein. In general, the presently disclosed systems and methods operate to fluctuate the speed of the basket in relatively quick succession over a speed range that extends just below and just above an expected or actual resonance speed or range of resonance speeds. In the illustrated embodiments, the speed fluctuation over this range has a generally sinusoidal trace showing either an accelerating or decelerating trend, depending on whether the overall speed change of the basket is accelerating or decelerating in nature as the resonance speed is crossed. In other words, the constantly changing acceleration, in short periods, while the speed trace undergoes the sinusoidal-type modulation is advantageously sufficient to avoid any resonance-induced vibration effects in the machine. In some embodiments, avoiding resonance-induced effects is achievable while dwelling for relatively brief time periods within the range of resonance speeds so long as the basket rotational speed does not remain constant within that range for more than a predetermined maximum dwell time. In some embodiments, the predetermined maximum dwell time can be determined by measuring the amount of time for the counterweight balls to transition from the out-of-phase position (FIG. 4) to the in-phase position (FIG. 5) at a constant rotational basket speed. It is believed that these desirable effects are exhibited during the speed modulation through the resonant speeds because, at least in part, dwell at a certain speed is minimized or eliminated, which in turn allows insufficient time for the weight-balancing devices to shift to an undesirable location in alignment with the basket load.

In reference now to the figures, resonance line 306 represents the resonance speed of the system as determined by the controller 42. The resonance line 306, therefore, represents the speed at which the system will experience a resonance frequency. As shown in the indicated section 304, as the speed plot nears the resonance line 306, the speed plot 302 has a first positive slope portion 312, representing an increase in basket 15 rotational speed to a speed that is greater than the resonance speed. The first positive slope portion 312 corresponds with a first positive acceleration period 356 on the acceleration plot 352, illustrating that the basket 15 has a positive acceleration as the basket's rotational speed passes the resonance speed. The first positive slope portion 312 terminates at a first peak speed 313. In the illustrated embodiment, the rotational speed remains constant for a time period that is less than the predetermined maximum dwell time. The speed plot 302 also has a first negative slope portion 314, representing a decrease in basket 15 rotational speed to a speed that is less than the resonance speed. As shown graphically, the first negative slope portion 314 corresponds to a first negative acceleration period 358 on the acceleration plot 352, illustrating that the basket 15 has a negative acceleration as the basket decelerates through the resonance speed. The first negative slope portion 314 terminates in a first trough speed 315. In the illustrated embodiment, the first trough speed 315 is substantially lower than the resonance speed, but the first trough speed can be above or near the resonance speed in other embodiments.

The speed plot 302 also shows a second positive slope portion 316 that represents another increase in basket 15 rotational speed, through the resonance speed indicated by line 306, to a speed that is greater than the resonance speed. A second positive acceleration period 360 of the acceleration plot 352 corresponds to the second positive slope portion 316 and illustrates that the basket 15 rotational acceleration is positive throughout the second positive slope portion as the basket rotational speed passes through the resonance speed. The second positive slope portion 316 terminates in a second peak speed 317. In the illustrated embodiment, the second peak speed 317 is greater than the first peak speed 313 and substantially greater than the resonance speed, but the second peak speed can be lower than the first peak speed or the resonance speed in other embodiments. The speed plot 302 also has a second negative slope portion 318 that represents another decrease in basket 15 rotational speed, through the resonance speed, to a speed that is less than the resonance speed. A second negative acceleration period 362 of the acceleration plot 352 corresponds to the second negative slope portion 318 and illustrates that basket 15 rotational acceleration is negative throughout the second negative slope portion as the basket rotational speed passes through the resonance speed. The second negative slope portion 318 terminates in a second trough speed 319. In the illustrated embodiment, the second trough speed 319 is a greater speed than the first trough speed 315 and less than the resonance speed, but the second trough speed can be less than the first trough speed or greater than the resonance speed in other embodiments.

The speed plot 302 also has a third positive slope portion 320, during which the basket 15 rotational speed increases to a rotational speed substantially above the resonance speed. A third positive acceleration period 364 of the acceleration plot 352 corresponds to the third positive slope 320 of the speed plot 302. Throughout the third positive slope portion 320, the rotational acceleration of the basket 15 remains positive, even as the rotational speed passes near the resonance speed. The third positive slope portion 320 terminates at a final cycle speed 321, which is a rotational speed that can be greater than the second peak speed 317 and greater than the resonance speed. As illustrated in the speed plot 302, the overall rotational speed of the basket 15 trends upwardly from a speed below the resonance line 306 to a speed above the resonance line through the indicated section 304. Even within the indicated section 304, the relative speeds of the peak speeds 313, 317 and trough speeds 315, 319 can increase to promote an upward trend in rotational speed throughout a wash cycle. As illustrated in the acceleration plot 352, however, the rotational acceleration of the basket 15 is always non-zero when the rotational speed of the basket nears or crosses the resonance line 306, or at least does not dwell at zero acceleration for longer than the predetermined maximum dwell time. In other words, the acceleration of the basket 15 is either positive or negative, but not zero for more than the predetermined maximum dwell time, when the rotational speed of the basket 15 nears the resonance speed.

When a desired dwell speed is near the resonance speed for a given system, the procedure plotted in FIG. 7A and FIG. 7B allows a system to achieve the desired results of the dwell speed without encountering the negative resonance effects associated with rotating the basket 15 at a constant speed near the resonance speed. As shown, the speed plot 302 in FIG. 7A shows an embodiment in which the controller 42 causes the rotational speed of the basket 15 to avoid dwelling at the resonance speed for longer than the predetermined maximum dwell time by performing two cycles of increasing the basket rotational speed above the resonance speed then below the resonance speed, then finally increasing the rotational speed above the resonance speed to perform the remainder of the wash operation. It is contemplated, however, that in other embodiments, the controller 42 can control the basket 15 rotational speed in any number of cycles that accelerate and decelerate the basket through the resonance speed without dwelling near the resonance speed for longer than the predetermined maximum dwell time.

In some embodiments, the controller 42 recognizes a maximum resonance speed, represented by a maximum resonance speed line 308 in FIG. 7A, which is greater than the resonance speed, and a minimum resonance speed, represented by a minimum resonance speed line 310 in FIG. 7A. The maximum resonance speed is a speed above which the basket 15 can rotate and not experience substantial negative resonance effect. Thus, rotational speeds in excess of the maximum resonance speed are substantially above the resonance speed as to reduce or avoid the negative effects of rotating the basket 15 at a constant speed near the resonance speed. Similarly, rotational speeds below the minimum resonance speed are substantially below the resonance speed as to reduce or avoid the negative effects of rotating the basket 15 at a constant speed near the resonance speed. At rotational speeds in the range between the minimum resonance speed 310 and the maximum resonance speed 308, maintaining a constant rotational basket 15 speed can potentially result in negative resonance effects. In such embodiments, the controller 42 controls the rotational acceleration of the basket 15 to be non-zero when the basket is rotating at a speed between the maximum resonance speed and the minimum resonance speed, or at least control the rotational acceleration of the basket to avoid zero acceleration for greater than the predetermined maximum dwell time. In some embodiments, the peak speeds 313, 317 are greater than maximum resonance speed 308, and the trough speeds 315, 319 are less than the minimum resonance speed 310. Referring to FIG. 7A and FIG. 7B, vertical lines A, B, C, D, E, and F show the times at which the speed plot 302 crosses the maximum resonance speed line 308 and the minimum resonance speed line 310. The time segments between lines A and B (segment AB), lines C and D (segment CD), lines E and F (segment EF) are the times during which the speed plot 302 is between the minimum resonance speed line 310 and the maximum resonance speed line 308. These segments represent the times during the illustrated cycle that the basket 15 rotational speed passes through the resonance speed, or at least potentially passes through the resonance speed. The vertical lines A-F are transposed onto the acceleration plot 352 in FIG. 7B. As shown in the acceleration plot 352, the rotational acceleration of the basket is either non-zero during each of segments AB, CD, and EF, or at least does not dwell at zero acceleration for more than the predetermined maximum dwell time. This represents that the basket 15 rotational speed does not dwell at any speeds between the maximum resonance speed and the minimum resonance speed for longer than the predetermined maximum dwell time.

Figure 8:
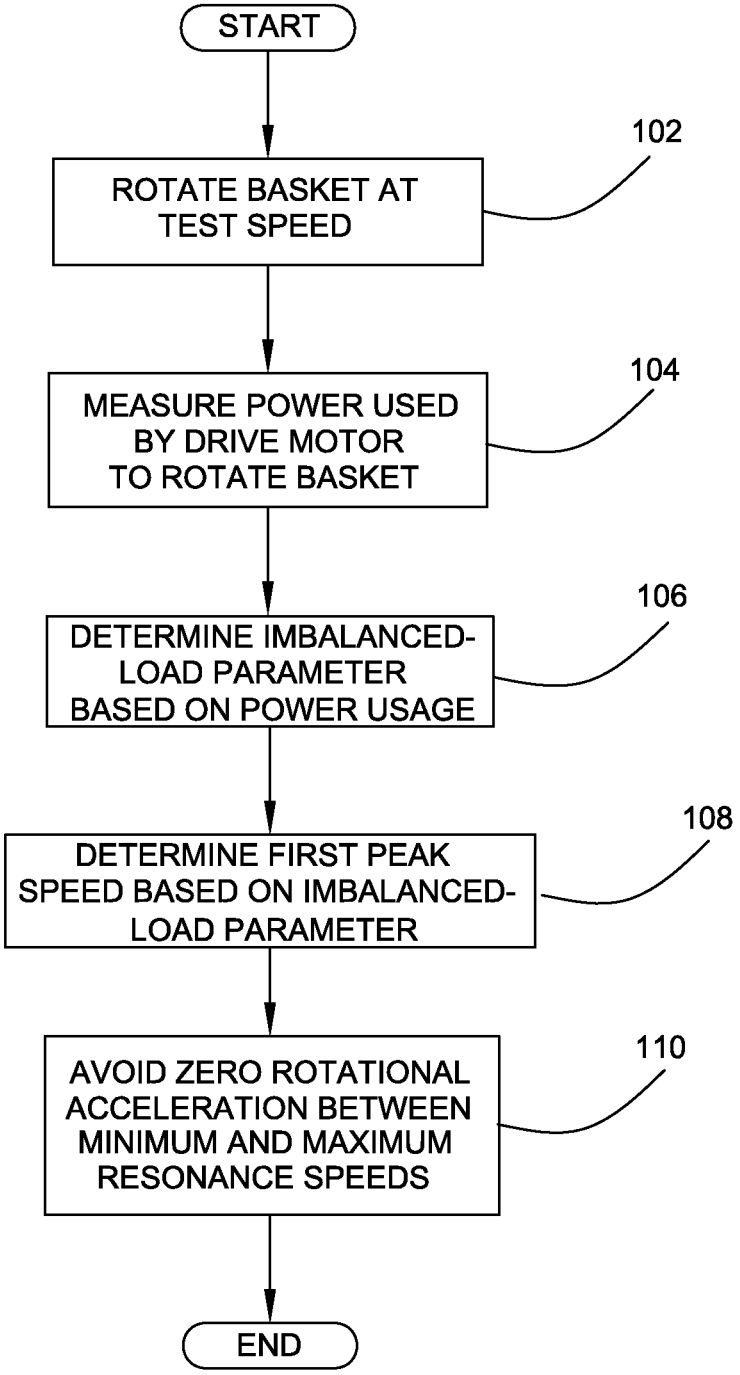
FIG. 8 is a flow chart illustrating a washing machine control procedure in accordance with the disclosure.

FIG. 8 is a flow chart illustrating an embodiment of controller 42 operation during a wash operation. At the beginning of a wash operation, the controller 42 determines an imbalanced-load parameter value associated with the particular load and load distribution. In alternative embodiments, the controller uses known methods to determine the weight of a wash load within the basket 15. Based on the value of the imbalanced-load parameter, the controller 42 determines whether to continue with the wash cycle or to redistribute the wash load. In the embodiment shown in FIG. 8 at 102, the controller 42 instructs the drive motor 19 to rotate the basket 15 at a predetermined test speed. Next, at 104, the controller 42 receives a signal from the drive motor 19 or elsewhere indicating the amount of power used by the drive motor 19 to rotate the basket 15 at the test speed, and any power fluctuations that occur while maintaining the test speed. Alternatively, the signal received by the controller 42 can allow the controller to measure the power used by the drive motor 19 at a particularly selected rotational basket 15 speed. At 106, the controller 42 determines an imbalanced-load parameter of the wash load based on the amount of power used by the drive motor 19 to rotate the basket 15 and the power fluctuations over time. Once the controller 42 has determined the imbalanced-load parameter, at 108, the controller can use that parameter to determine a first peak speed. Alternatively, the controller can use the power drawn by the motor 19 to determine resonance speeds using predetermined empirical data. Another factor that can be taken into account when determining the resonance speed is balance ring position or configuration. At 110, the controller 42 performs the wash operation without permitting the motor 19 to rotate the basket 15 at zero rotational acceleration for more than a predetermined maximum dwell time when the basket is rotating between a predetermined minimum resonance speed and a predetermined maximum resonance speed. In alternative embodiments, the controller 42 can perform the wash operation without permitting the motor 19 to rotate the basket 15 at zero rotational acceleration for more than a predetermined maximum dwell time when the basket is rotating at or near the resonance speed.

Figure 9A:
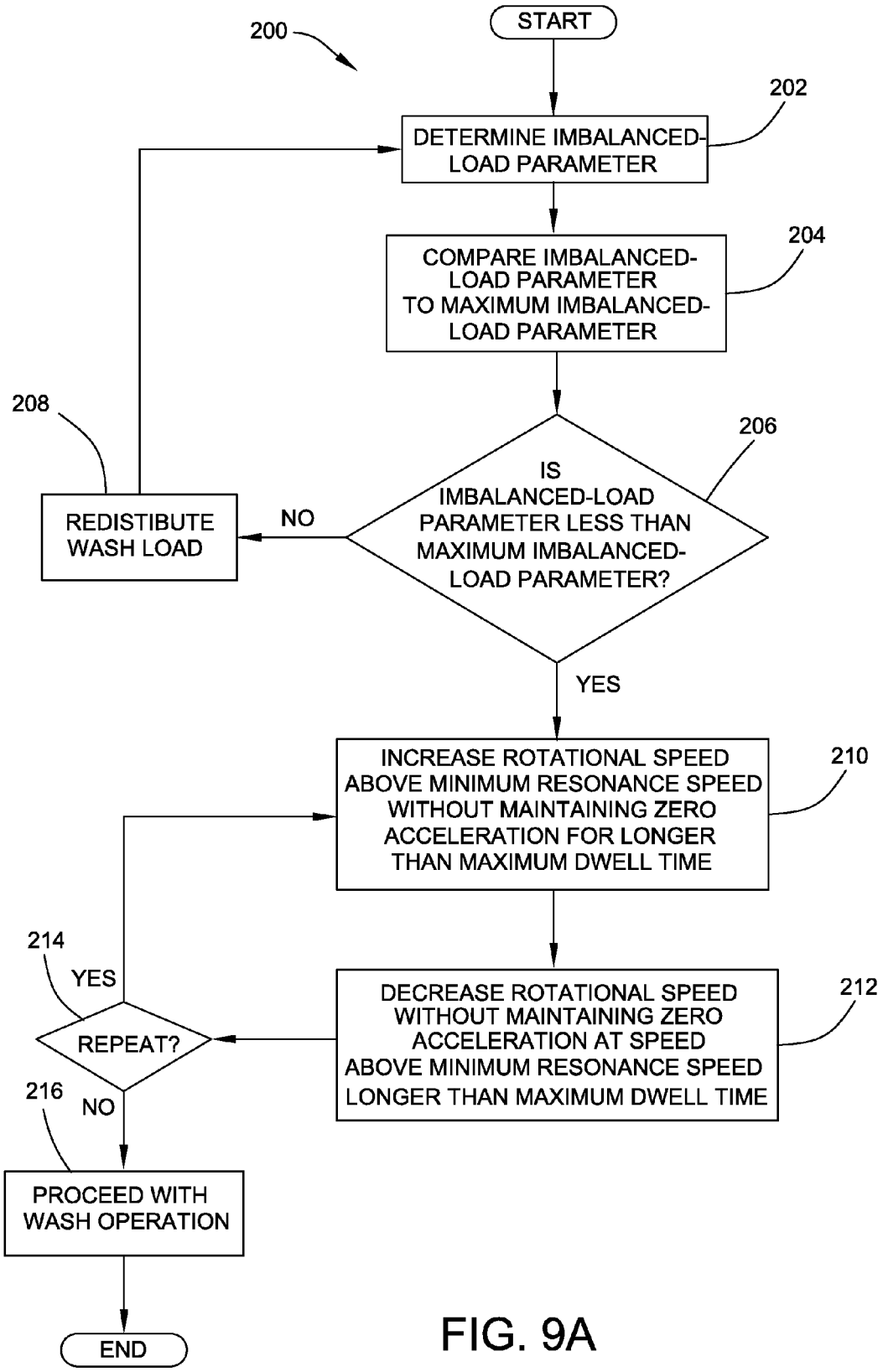
FIG. 9A is a flow chart illustrating another washing machine control procedure in accordance with the disclosure.

FIG. 9A illustrates an embodiment of a process 200 by which the controller 42 can avoid sustained rotation of the basket 15 at or near a resonance frequency for more than a predetermined maximum dwell time. The embodiment involves instructing the drive motor 19 to rotate the basket 15 at varying rotational speeds between a predetermined minimum resonance speed and a predetermined maximum resonance speed without allowing the rotational speed to remain constant for more than a predetermined maximum dwell time between the minimum and maximum resonance speeds. In this way, the controller 42 can help alleviate negative resonance effects. At 202, the controller 42 determines an imbalanced-load parameter at a test speed that is below a predetermined minimum resonance speed using the process described above or any other suitable process. At 204, the controller 42 compares the imbalanced-load parameter to an empirically determined maximum imbalanced-load parameter.

When the imbalanced-load parameter is greater than the maximum imbalanced-load parameter, the controller 42 instructs the drive motor 19 to redistribute the wash load within the basket at 208. In some embodiments, redistribution of the wash load is accomplished by varying the rotational speed of the basket 15, for example, by reducing the rotational speed of the basket 15 to redistribute the wash load within the basket, then increase the rotational speed again to the test speed to re-determine the imbalanced-load parameter.

When the imbalanced-load parameter is less than the maximum imbalanced-load parameter, the controller 42 instructs the drive motor 19 to increase the rotational speed of the basket 15 to a first peak speed without maintaining zero acceleration for more than a predetermined maximum dwell time. In the illustrated embodiment, the first peak speed is greater than the minimum resonance speed and less than a predetermined maximum resonance speed. At 212, the controller 42 instructs the drive motor 19 to decrease the basket 15 rotational speed without maintaining zero rotational acceleration at a rotational speed above the minimum resonance speed for longer than the predetermined maximum dwell time. At 214, the controller 42 can instruct the drive motor 19 to repeat step 210 by increasing rotational speed to a speed above the minimum resonance speed without dwelling for longer than maximum dwell time, followed by decreasing the rotational speed as desired to accomplish the function of the wash cycle.

Once the controller 42 determines that the desired wash-cycle function has been accomplished, the controller can instruct the drive motor 19 to continue at the speed appropriate for the next portion of the wash operation at 216. In some embodiments, the controller 42 determines whether to move on to the next portion of the wash operation by instructing the drive motor 19 to rotate the basket 15 at a constant speed that is lower than the minimum resonance speed. In such embodiments, the controller 42 can monitor the power drawn by the drive motor 19 to determine another imbalanced-load parameter indicative of whether the controller should move on to the next portion of the wash operation.

Figure 9B:
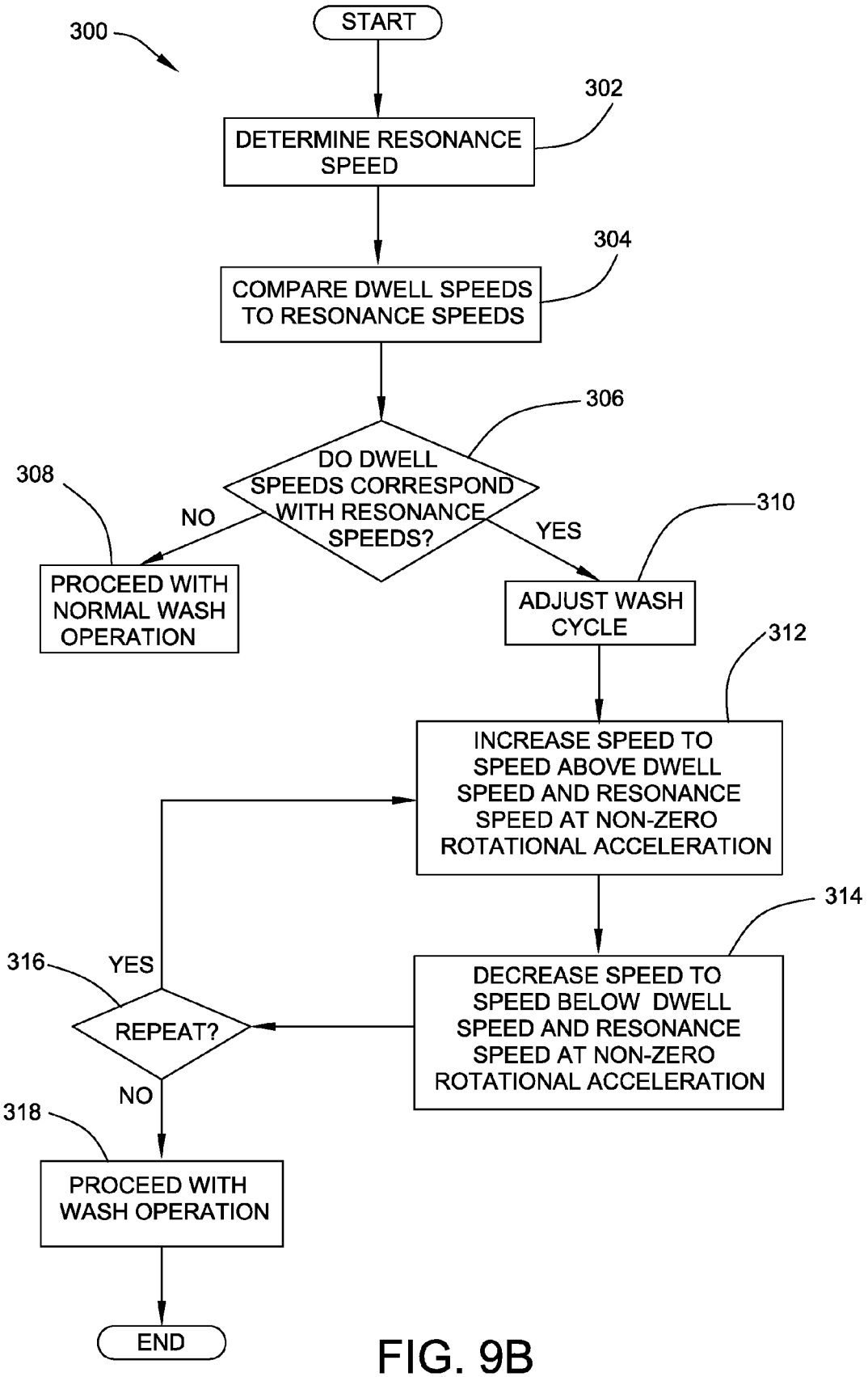
FIG. 9B is a flow chart illustrating another washing machine control procedure in accordance with the disclosure.

FIG. 9B illustrates another embodiment of a process 300 by which the controller 42 can substantially avoid the negative effects of resonance speeds. At 302, the controller 42 determines the resonance speed or speeds using the process described above or any other suitable process. At 304, the controller 42 compares the resonance speeds to the preferred dwell speeds of the selected washing operation. At 306, the controller 42 determines whether the selected wash operation for the washing machine 10 includes wash cycles with preferred dwell speeds that are at or near any resonance speeds. When no dwell speeds correspond with the resonance speed, the washing operation can proceed normally, shown at 308, without regard to resonance speed problems. When the controller 42 determines that at least one dwell speed is at or near any resonance speeds, the controller adjusts the wash cycle accordingly, as shown at 310. At 312, instead of sustaining the basket rotational speed near the dwell speed, the controller 42 instructs the drive motor 19 to increase the rotational speed of the basket 15 to at least a speed that is greater than the dwell speed and resonance speed, while maintaining a non-zero rotational acceleration at or near the resonance speed. In some embodiments, the controller 42 can instruct the drive motor 19 to sustain the basket 15 rotational speed at a speed substantially above the resonance speed for a time interval, such as between 0 seconds and 1 second, or for another predetermined time. At 314, the controller 42 instructs the drive motor 19 to gradually decrease the rotational speed of the basket 15 to a speed that is less than the dwell speed or resonance speed, while maintaining a non-zero rotational acceleration at or near the resonance speed. At 316, the controller 42 can instruct the drive motor 19 to repeat step 312 by increasing the rotational speed to a speed higher than the dwell speed and resonance speed, followed by step 314 of gradually decreasing the rotational speed to below the dwell speed and resonance speed, as desired to accomplish the function of the wash cycle. Once the controller 42 determines that the appropriate number of accelerations above the dwell speed and decelerations to below the dwell speed have been performed to accomplish the desired wash-cycle function, the controller, at 318, can instruct the drive motor 19 to continue at the speed appropriate for the next portion of the wash operation.

An example of the process illustrated in FIG. 8 and FIGS. 9A and 9B can occur during a dehydration cycle, when the washing machine 10 removes soap suds and water from the wash load. The controller 42 can increase the rotational speed to a speed between the minimum resonance speed and the maximum resonance speed and maintain a constant speed for between, inclusively, about 0 seconds and about 5 seconds. The controller 42 then reduces the rotational speed gradually, which can provide time for the water and suds to be removed from the basket 15. Because lower rotational speeds may not extract as much water as higher rotational speeds, the controller 42 may instruct the drive motor 19 to increase the rotational speed to a speed between the minimum and maximum resonance speeds without dwelling for more than the predetermined maximum dwell time. In some embodiments, the predetermined maximum dwell time can be in a range between about six seconds and about twelve seconds, or between about eight seconds and about ten seconds in other embodiments. In other embodiments, the predetermined maximum dwell time is about 8 seconds. The near-constant varying of rotational speeds keeps the counterweight balls 34 in the balance ring 28 in a lag, or out-of-phase, position behind the imbalanced mass 36 in the basket 15. When kept in a lag position, the counterweight balls 34 cannot "catch up" with the imbalanced mass 36 to reach an in-phase condition. Thus, the basket 15 will stay well balanced throughout a range of rotational speeds that maximizes the removal of water and soap suds without causing excessive machine motion or other negative effects. The controller 42 can instruct the drive motor 19 to accelerate and decelerate through the range between the minimum and maximum resonance speeds as many times as necessary for the washing machine 10 to adequately remove soap suds and water from the wash load. The amount of sequential accelerations and decelerations can be determined as a predetermined amount based on the type of wash cycle or wash operation. Alternatively, the number of sequential accelerations and decelerations through the resonance speed can be determined by sensing the changing weight of the load and halting the acceleration and deceleration sequences when a predetermined or calculated desirable load weight is reached.

Alternatively or in addition to the procedures shown in FIGS. 8, 9A, and 9B, during wash operation periods for which the rotational speed of the basket 15 is changing, the controller 42 can adjust the acceleration and deceleration of the rotational speed to match the lag time of the counterweight balls 34 in the balance rings 28. In such a procedure, the basket speed matches the counterweight speed, and the counterweight balls 34 do not "catch-up" with the imbalanced mass 36 and enter an in-phase position. As a result, the counterweight balls 34 remain in the out-of-phase position opposite the imbalanced mass 36 in the basket 15 and the negative effects due to an imbalanced load are reduced.

Figure 10A:
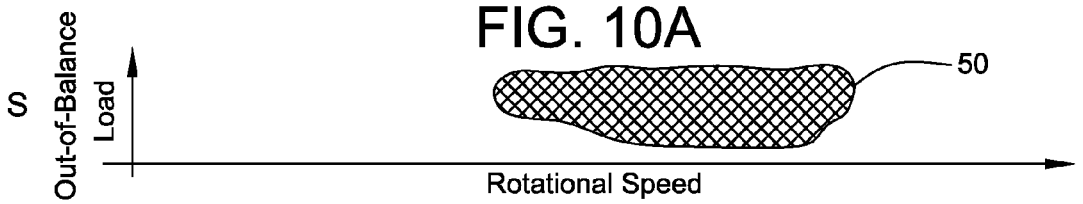
FIGS. 10A-10C are a series of tables indicating empirical washer performance information during a traditional or baseline machine cycle.
Figure 10B:
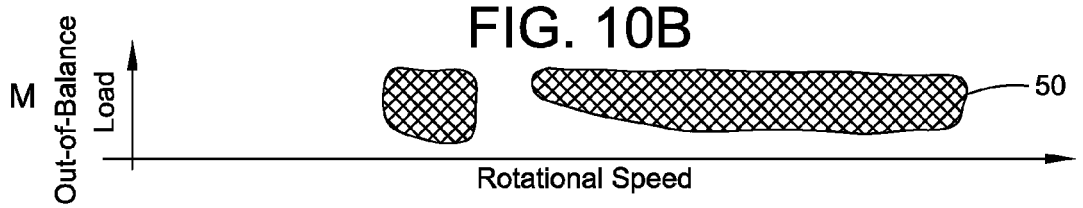
Figure 10C:
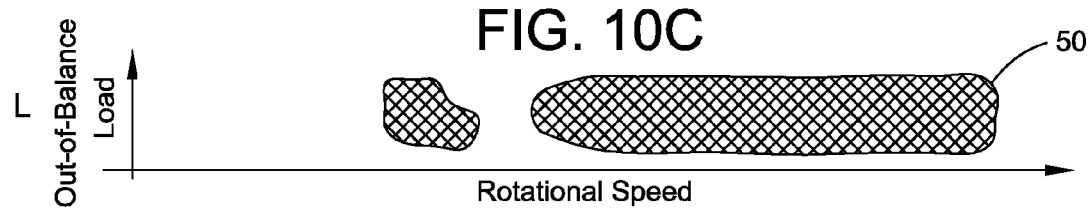

FIG. 10 and FIG. 11 illustrate the difference in effects encountered empirically between traditional wash operations and wash operations using the disclosed methods and processes. FIGS. 10A, 10B, and 10C show plots of empirically produced data. Each plot in FIG. 10 illustrates the effects associated with running previously known washing machine operations. Each plot represents an operating condition at a constant distributed load. In each plot, a varied out-of-balance load is rotated at various machine rotational speeds. In the illustrated figures, the horizontal axes represent increasing rotational speed of the basket 15 and the vertical axes represent increasing out-of-balance load. Each plot in FIG. 10 shows results using different levels of distributed load, shown as S (small) in FIG. 10A, M (medium) in FIG. 10B, and L (large) in FIG. 10C. In each figure, the shaded areas 50 indicate operating conditions in which above-normal vibration and/or noise were present during experimentation. For example, above-normal vibration can include excessive noise or excessive machine movement as a result of an imbalanced load.

Figure 11A:
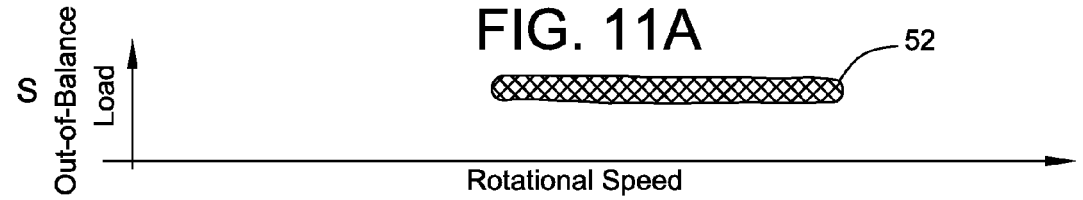
FIG. 11A-11C are a series of tables indicating empirical washer performance information during a machine cycle in accordance with the disclosure.
Figure 11B:
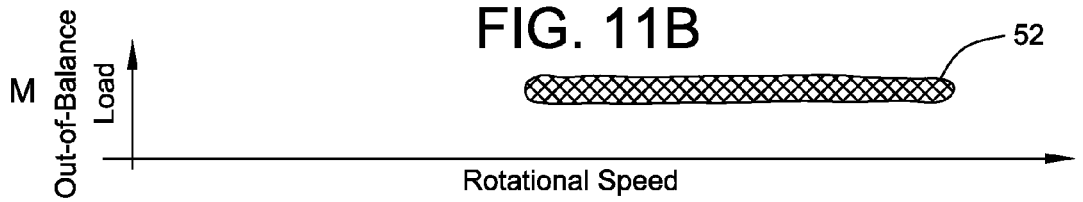
Figure 11C:
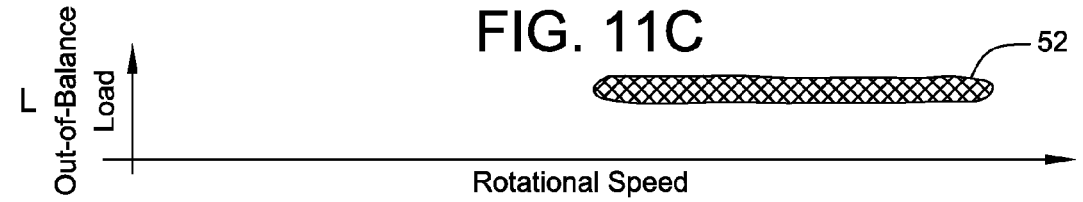

FIG. 11 illustrates plots produced under the same experimental conditions as illustrated in FIG. 10. FIGS. 11A, 11B, and 11C, however, represent the negative effects recorded when using the wash operations disclosed herein and illustrated in FIG. 7, FIG. 8, FIG. 9A, and FIG. 9B. FIG. 11A shows a small distributed load (S), FIG. 11B shows a medium distributed load (M), and FIG. 11C shows a large distributed load (L). As with the shaded areas 50 of FIG. 10, the shaded areas 52 of FIG. 11 indicate operating conditions in which negative effects were recorded during experimentation using the disclosed washing operation procedures and apparatus. As is evident from the figures, the plots in FIG. 11 indicate far fewer negative effects from imbalanced loads than the corresponding plots in FIG. 10. This indicates that the disclosed procedures, methods, and apparatuses can reduce excessive machine movement and noise that can result from imbalanced loads in washing machines during wash operations.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A washing machine system comprising:

an outer tub;

a cylindrical basket rotatably supported within the outer tub, the basket shaped and sized to receive launderable items and wash water during a wash operation;

a drive motor selectively rotating the basket during the wash operation;

a balance ring associated with the basket, the balance ring containing at least one counterweight adapted to move within the balance ring to compensate for an imbalanced mass during rotation of the basket; and a controller in electronic communication with the drive motor, the controller programmed to:

send signals to the drive motor instructing the drive motor to rotate the basket at selective rotational speeds, and receive electronic signals indicating an amount of power used by the drive motor to rotate the basket at the selective rotational speeds;

wherein the controller determines a minimum resonance speed and a maximum resonance speed and compensates for the imbalanced mass during rotation of the basket; and wherein the controller causes the drive motor to rotate the basket according to a constantly variable rotational acceleration from the predetermined minimum resonance speed to the predetermined maximum resonance speed.

2. The washing machine system of claim 1, wherein the controller further instructs the drive motor to rotate the basket at only the constantly variable rotational acceleration when the rotational speed of the basket is between the maximum resonance speed and the minimum resonance speed.

3. The washing machine system of claim 2, wherein the controller further instructs the drive motor to successively accelerate the rotational speed of the basket to a speed above the minimum resonance speed and to decelerate the basket to a speed below the maximum resonance speed.

4. The washing machine system of claim 1, wherein the controller further instructs the drive motor to, successively:

increase the rotational speed of the basket during a first positive acceleration period to at least a first peak speed, which is greater than the minimum resonance speed, decrease the rotational speed of the basket during a first negative acceleration period to a first trough speed, which is less than the maximum resonance speed, increase the rotational speed of the basket during a second positive acceleration period to a second peak speed, which is greater than the first peak speed, decrease the rotational speed of the basket during a second negative acceleration period to a second trough speed, which is greater than the first trough speed, and increase the rotational speed of the basket during a third positive acceleration period to at least a final cycle speed, which is greater than the maximum resonance speed.

5. The washing machine system of claim 4, wherein the controller instructs the drive motor to maintain the constantly variable rotational acceleration of the basket during the first, second, and third positive acceleration periods and the first and second negative acceleration periods.

6. The washing machine system of claim 1, wherein the basket rotates at a basket speed, and the counterweight balls rotate at a counterweight speed, and wherein the controller controls the acceleration and deceleration of the basket speed such that the basket speed matches the counterweight speed.

7. The washing machine system of claim 1, wherein the controller further determines an imbalanced-load parameter based on the amount of power used by the drive motor to rotate the basket at the selective rotational speeds.

8. The washing machine system of claim 7, wherein the controller further instructs the drive motor to accelerate the rotational speed of the basket above the minimum resonance speed when the imbalanced-load parameter is less than a maximum imbalanced-load parameter value.

9. The washing machine system of claim 7, wherein the controller further instructs the drive motor to reduce the rotational speed of the basket when the imbalanced-load parameter is greater than a maximum imbalanced-load parameter value to redistribute the launderable items within the basket.

10. A method of operating a washing machine system, the method comprising:

providing an outer tub;

rotatably supporting a cylindrical basket within the outer tub, the basket sized and shaped to receive launderable items and wash water during a wash operation;

providing a drive motor selectively rotating the basket during the wash operation;

mounting a balance ring to the periphery of the basket, the balance ring containing at least one counterweight ball movable within the balance ring to compensate for an imbalanced mass during rotation of the basket;

electronically connecting a controller to the drive motor;

sending signals to the drive motor from the controller instructing the drive motor to rotate the basket at selective rotational speeds;

receiving signals with the controller indicating an amount of power used by the drive motor to rotate the basket at the selective rotational speeds; and using the controller to determine a minimum resonance speed and a maximum resonance speed and instruct the motor to rotate the basket at a constantly variable acceleration when the rotational speed of the basket is operated from the minimum resonance speed to the maximum resonance speed.

11. The method of claim 10 further comprising using the controller to instruct the drive motor to rotate the basket at only the constantly variable rotational acceleration when the rotational speed of the basket is between the maximum resonance speed and the minimum resonance speed.

12. The method of claim 11 further comprising using the controller to instruct the drive motor to successively accelerate the rotational speed of the basket to a speed above the maximum resonance speed and to decelerate the basket to a speed below the minimum resonance speed.

13. The method of claim 10 further comprising using the controller to instruct the drive motor to, successively:

increase the rotational speed of the basket during a first positive acceleration period to at least a first peak speed, which is greater than the minimum resonance speed, decrease the rotational speed of the basket during a first negative acceleration period to a first trough speed, which is less than the maximum resonance speed, increase the rotational speed of the basket during a second positive acceleration period to a second peak speed, which is greater than the first peak speed, decrease the rotational speed of the basket during a second negative acceleration period to a second trough speed, which is greater than the first trough speed, and increase the rotational speed of the basket during a third positive acceleration period to at least a final cycle speed, which is greater than the maximum resonance speed.

14. The method of claim 13 further comprising using the controller to instruct the drive motor to maintain the constantly variable rotational acceleration of the basket during the first, second, and third positive acceleration periods and the first and second negative acceleration periods.

15. The method of claim 10, wherein the basket rotates at a basket speed, and the counterweight balls rotate at a counterweight speed, and wherein the controller controls the acceleration and deceleration of the basket speed such that the basket speed matches the counterweight speed.

16. The method of claim 10, wherein the controller further determines an imbalanced-load parameter based on the amount of power used by the drive motor to rotate the basket at the selective rotational speeds.

* * * * *